United States Patent [19]

Coupar

[11] 4,140,316

[45] Feb. 20, 1979

[54] TENNIS RACQUET

[76] Inventor: Robert B. Coupar, 4447 Narvaez Crescent, Victoria, British Columbia, Canada, V8N 2S7

[21] Appl. No.: 828,224

[22] Filed: Aug. 26, 1977

[51] Int. Cl.[2] ..... A63B 51/14; A63B 51/02

[52] U.S. Cl. ..... 273/73 A; 273/73 D

[58] Field of Search ..... 273/73 R, 73 A, 73 B, 273/73 C, 73 D, 73 E, 73 H, 73 L, 58 C; 35/27; 84/297 R

[56] References Cited

U.S. PATENT DOCUMENTS

| | | | |
|---|---|---|---|
| 640,555 | 1/1900 | Fuller | 273/130 R |
| 840,467 | 1/1907 | Beard | 273/73 D |
| 1,292,317 | 1/1919 | Holding | 273/73 D |
| 1,621,746 | 3/1927 | Morten | 273/73 D |
| 1,962,701 | 6/1934 | Andrews | 273/73 E |
| 2,059,917 | 11/1936 | Spencer | 273/73 D |
| 2,091,654 | 8/1937 | Roberts et al. | 273/73 B X |
| 3,548,484 | 12/1970 | Carlton | 273/73 D X |
| 3,709,491 | 1/1973 | Minchin | 273/58 C |
| 3,837,649 | 9/1974 | Burchett | 273/73 A |
| 3,966,207 | 6/1976 | Pass | 273/73 D |
| 3,994,495 | 11/1976 | Stoffel | 273/73 D X |
| 4,026,553 | 5/1977 | Vendramini | 273/73 E |

FOREIGN PATENT DOCUMENTS

| | | | |
|---|---|---|---|
| 125055 | 8/1947 | Australia | 273/73 D |
| 3127 of | 1885 | United Kingdom | 273/73 D |
| 23260 of | 1908 | United Kingdom | 273/73 D |
| 287775 | 3/1928 | United Kingdom | 273/73 D |
| 887526 | 1/1962 | United Kingdom | 273/73 D |

*Primary Examiner*—Richard J. Apley

*Attorney, Agent, or Firm*—Fulwider, Patton, Rieber, Lee & Utecht

[57] ABSTRACT

A racquet, for tennis or the like, and a method for stringing racquets. The racquet has a handle, a frame, and a plurality of strings spanning the frame in two groups. A first group is generally parallel to the handle and a second group is generally perpendicular to the handle. Each string spans the frame once and has retaining means on each end for maintaining the string taut while spanning the frame. An apparatus for determining the distance between retaining means on each end of a string for making a single span of a racquet frame includes at least one first position and a plurality of second positions on a surface. A taut string, having a first retaining means at a first position and a second retaining means at a second position, has a predetermined tension when placed in the frame. An apparatus for stringing a racquet includes a body portion for fitting onto the frame and a winch key rotatably on the body portion.

9 Claims, 9 Drawing Figures

TENNIS RACQUET

BACKGROUND OF THE INVENTION

This invention relates to apparatus and a method for stringing a racquet with a plurality of strings, each string spanning the racquet frame once.

Racquets for tennis and the like comprise a frame having a handle and a plurality of spaced apertures about the frame. At least one string is strung from each aperture to a corresponding aperture on the opposite side of the frame to provide spaced strings both parallel and perpendicular to the handle. The tension at which the racquet is strung should be determined quite accurately and relatively complex and expensive equipment has been developed for this purpose; for example, U.S. Pat. No. 3,913,912 to Smith. When a string breaks during play, the racquet must be returned to a shop or other location having such equipment for repairing the racquets.

Simplified equipment for replacing a string broken in play has been suggested, for example, in U.S. Pat. No. 3,837,649 to Burchett. This equipment still must include means for determining the tension of the strings at the time the racquet is repaired.

It has been suggested in the past, for example in U.S. Pat. No. 1,687,848 to Robinson, that individual strings could be employed for spanning the racquets once between corresponding apertures. Robinson employs a relatively complex system of apertures in the racquet frame and a system for passing the strings through the apertures for retaining the strings on the racquet. Robinson doesn't disclose means for readily calculating before hand the tension which a string will have when placed on the racquet.

SUMMARY OF THE INVENTION

According to one aspect of this invention, there is provided a string for stringing a racquet frame having an inside surface and an outside surface. The string has two ends, and a length for one span of the frame, and means on each end for maintaining the string taut while spanning the frame. Preferably, the means for maintaining the string taut has a cross sectional extent greater than each of a plurality of apertures between the inside surface and the outside surface of the frame, the means preventing each end of the string from passing through the apertures. For example, the means comprises a knot on each end of the string and a collar for placing over the string between each knot and the outside surface of the frame, the collars having an inside cross sectional extent smaller than the knot and an outside cross-sectional extent greater than the apertures.

According to a second aspect of the invention, there is provided a racquet comprising a racquet frame with a handle. The frame has an inside, an outside, and a plurality of first apertures passing from the inside of the frame to the outside of the frame and spaced apart on the frame for stringing the racquet. A plurality of strings span the frame in two groups of spaced parallel strings. A first group is generally parallel to the handle and a second group is generally perpendicular to the handle. Each string has two ends, spans the frame between two apertures, and has retaining means on each end for maintaining the strings taut while spanning the frame. Preferably, the racquet includes a plurality of collars having an inside aperture and an outside, the inside aperture being smaller than the retaining means and the cross sectional extent of the outside of the collars being greater than the first apertures in the frame, each collar being placed over one end of the string between a retaining means and the outside of the frame.

According to a third aspect of the invention, there is provided an apparatus for determining the distance between retaining means on each end of a string for making a single span of a racquet frame. The apparatus comprises a surface, at least one first position on the surface, at least one first means for holding a first end of the string at each first position, and a plurality of second positions in spaced relationship with the first position such that a string, having the retaining means spaced generally the same distance apart as a first position and a corresponding second position, will have a predetermined tension when placed on the frame.

According to a fourth aspect of the invention, there is provided an apparatus for stringing a racquet with strings, each string spanning the racquet frame once. The apparatus comprises a body portion having clamping means for fitting on the racquet frame, a winch key rotatable on the body for winding one end of a string thus tensioning the string, and a stop means engageable with the winch key to prevent the string unwinding from the key.

According to a fifth aspect of the invention, there is provided a method for stringing a racquet. The method comprises: providing a racquet frame having a handle, a centre, an inside, an outside, and a plurality of apertures between the inside and outside spaced about the frame; providing a plurality of strings, each string having a length for one span of the frame, the strings having a first end, a second end and first retaining means at the first end, the first retaining means for preventing the first end of each string from passing through the apertures; passing the second end of each string through a first aperture from the outside of the frame to the inside; passing the second end of each string through a corresponding second aperture from the inside of the frame to the outside so that the strings form two sets of strings, a first set generally parallel to the handle and a second set generally perpendicular to the handle; tensioning each string; and providing second retaining means on the second end of each string so that second end of each string will not pass through the second apertures and each string spans the racquet at a predetermined tension. Preferably, at least one string of the second set is first strung near the centre of the racquet, the first set of strings is then strung in corresponding pairs beginning near the centre of the racquet and progressing outwards and the stringing of the second set of strings is then completed.

In drawings which illustrate embodiments of the invention:

DESCRIPTION OF THE PREFERRED EMBODIMENT

Figure 1:
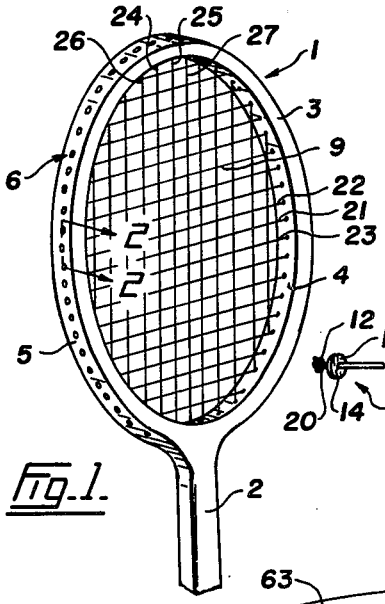
FIG. 1 is a perspective view of a tennis racquet according to an embodiment of the invention.

FIG. 1 shows a tennis racquet 1 having a frame 3 with a handle 2. The frame has an inside 4 and an outside 5. A plurality of apertures 6 pass from the inside 4 to the outside 5 and are spaced around the frame for stringing the racquet.

Figure 2:
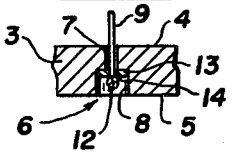
FIG. 2 is a sectional view taken along section 2—2 of FIG. 1.
Figure 8:
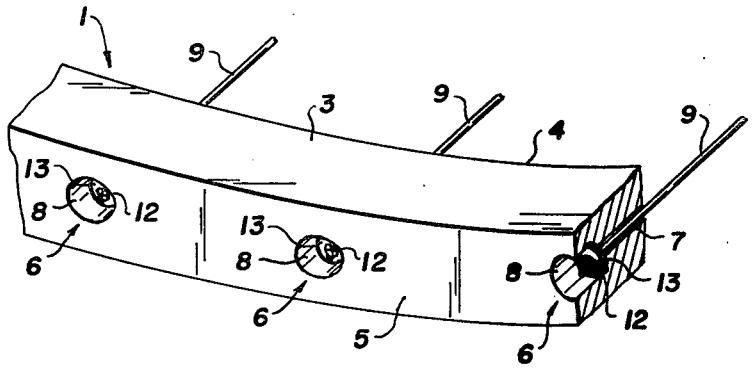
FIG. 8 is an enlarged view of part of the frame of the racquet shown in FIG. 1.

As seen in FIGS. 2 and 8, the apertures 6 comprise first apertures 7 and second apertures 8. Apertures 7 communicate with the inside 4 of the frame and communicate concentrically with apertures 8. Apertures 8 communicate with the outside 5 of the frame.

Figure 3:
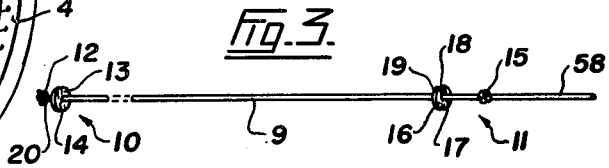
FIG. 3 is a perspective view of a racquet string and retaining means according to another embodiment of the invention.

A plurality of strings 9 span the frame both parallel to the handle 2 and perpendicular to the handle 2. Each string 9, as seen in FIG. 3, has two ends 10 and 11 and, as seen in FIG. 1, each string spans the racquets between two apertures 6. The ends 10 and 11 of the string 9 each have retaining means for maintaining the strings taut while spanning the frame 3. The retaining means at end 10, as shown in FIGS. 2, 3 and 8, consists of figure-eight knot 12 and nylon washer 13. The knot 12 is too large to pass through the aperture 14 in the washer 13. The washer 13 is slightly smaller than the second aperture 8 but larger than the first aperture 7. Consequently, washer 13 prevents knot 12 from passing through the first aperture 7. End 11 of the string 9 has similar retaining means consisting of figure-eight knot 15 and nylon washer 16 having an aperture 17. Knots 12 and 15 comprise portions of string 9 of increased cross-sectional extent near ends 10 and 12 respectively. Knots 12 and 15 have a cross-sectional extent generally equal to first apertures 7. Nylon washer 16, however, has a slit 18 between the outside 19 of the washer and the aperture 17. Slit 18 is V-shaped so washer 16 can be easily pushed over the string 9. As seen in FIG. 3, each string 9 has a colour band 20 adjacent knot 12 for indicating the predetermined tension which the string will have when placed in the proper location on the racquet.

Generally, the placement of a string 9 on the racquet 1 consists of threading end 11 of a string 9 through a second aperture 8 and then through a first aperture 7 with washer 16 removed from the string 9 so that string 9 passes from the outside 5 of the frame 3 to the inside 4. End 11 of string 9 is pulled until washer 13 is retained within second aperture 8 against first aperture 7, as shown in FIG. 2. End 10 of the string 9 is therefore effectively secured since knot 12 will not pass through aperture 14 in washer 13. End 11 of string 9 is then passed through a corresponding aperture 6 on the opposite side of the frame 3 from the inside 4 to the outside 5. Tension is applied to end 11 of string 9 until knot 15 clears the outside 5 of the frame 3. Washer 16 is then placed over string 9 between knot 15 and the frame 3. The distance between knots 12 and 15 is predetermined so that knot 12 is held tightly against washer 13 and knot 15 is held securely against washer 16. Washers 13 and 16 are retained within corresponding second bores 8 on opposite sides of the frame. Since washer 16 is only slightly smaller than second bores 8, split 18 is prevented from widening and releasing end 11 of string 9.

The following is a method of stringing a racquet which should be employed when all the strings on the racquet are to be replaced, or if the racquet is to be strung for the first time. The tension at which the racquet is to be strung is first chosen, for example 50 lbs, and a set of strings having an appropriate colour band 20, as shown in FIG. 3, corresponding to, for example, 50 pounds is chosen. Since the strings vary in length, the set of strings must be packaged on a card in the appropriate order, or, alternatively, additional color bands or numbers could be used on the individual strings to indicate their respective position. For example, strings parallel to the handle 2 could be numbered 1 to 9 from left to right and strings perpendicular to the handle could be lettered "A" to "R" or "S" from top to bottom. Other means of identifying individual strings are possible. In stringing the racquets, a string perpendicular to the handle 2 of the racquet 1 is first placed on the racquet in the manner indicated above, for example, string 21. Preferably, one or two additional strings perpendicular to the handle 2, for example strings 22 and 23, are placed on the racquet frame 3. The racquet is then strung with strings running parallel to the handle 2 in corresponding pairs beginning at the centre of the racquet 1. Strings 24 and 25 are first placed on the racquet, then the next pair of strings 26 and 27. This procedure is continued until all strings are running parallel to the handle 2 are placed on the racquets. The stringing of strings perpendicular to the handle 2 is then completed in any convenient manner.

Figure 7:
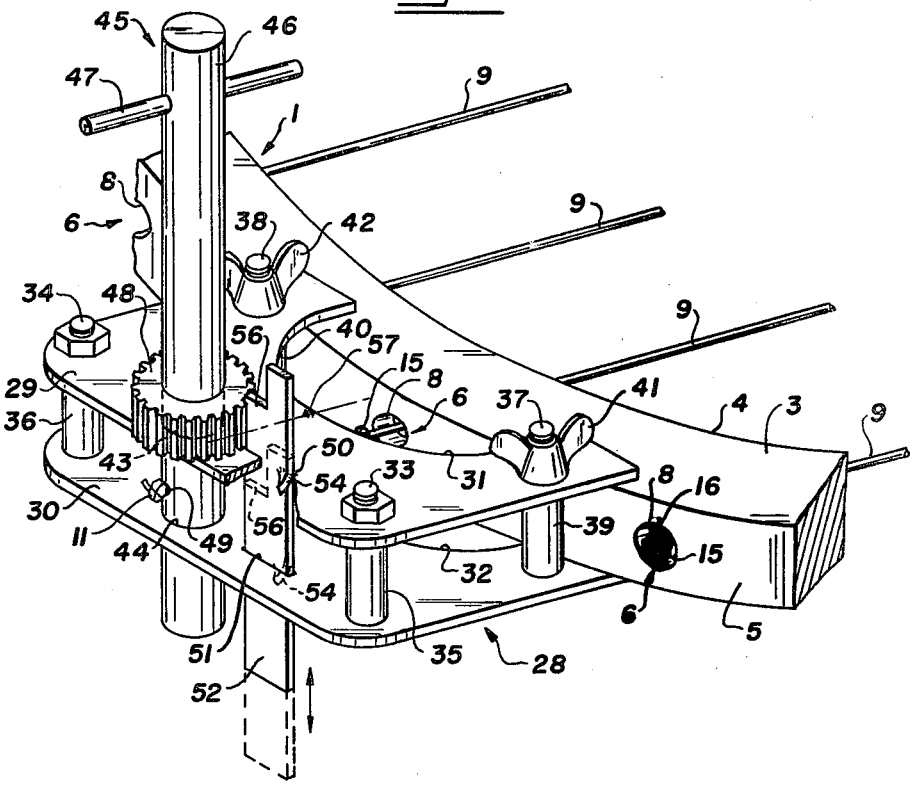
FIG. 7 is a perspective view of an apparatus for stringing a racquet frame according to another embodiment of this invention.

String winch 28, illustrated in FIG. 7, is employed for tensioning strings 9, shown in FIG. 1, when placing strings 9 on the racquet 1. The winch consists of generally rectangular plates 29 and 30 with corresponding semi-circular openings 31 and 32 for fitting the winch to the racquet 1. Plates 29 and 30 are spaced generally ¾ inch apart by nut and bolt 33 and nut and bolt 34, with corresponding tubular sleeves 35 and 36, and by bolts 37 and 38 with corresponding tubular sleeves 39 and 40 (not shown). Bolts 37 and 38 also have corresponding wing nuts 41 and 42. Sleeves 35 and 36 are slightly longer than the width of the racquet frame 3, but sleeves 39 and 40 are slightly shorter than the width of the frame 3. Consequently, winch 28 can be clamped to frame 3, shown in FIG. 1, by tightening wing nuts 41 and 42. The plates 29 and 30 also have corresponding apertures 43 (not shown) and 44 for receiving winch key 45. Key 45 has a shaft 46 rotatable within apertures 43 and 44, a handle 47 for turning key 45 and a toothed gear 48 on shaft 46. An aperture 49 on key 45 is for receiving an end 11 of string 9. The key 45 is made of nylon but could be made of other suitable materials. Plates 29 and 30 also have corresponding slots 50 and 51 adjacent apertures 43 and 44 respectively for receiving stop 52, preferably made of metal. Stop 52 has a turned up corner 54 located between plates 29 and 30. The turned-up corner 54 serves to position stop 52 between plates 29 and 30. When stop 52 is moved toward plate 29, edge 56 of stop 52 engages with gear 48 on key 45, thus preventing key 45 from turning. When it is desired to tension a string 9, the coloured dot 57 on plate 29 is positioned adjacent an aperture 6 on the frame 3 through which end 11 of a string 9 has been passed. It should be noted that apertures 43 and 44 are offset relative to coloured dot 57 so that the periphery of shaft 46 is adjacent dot 57. Consequently, the strings 9 will be tensioned in a straight line by the winch 28.

As seen in FIG. 3, end 11 of string 9 has a free end 58. When placing a string 9 on the racquet frame, the free end 58 is passed through aperture 49 in key 45 and a knot is then made on the free end 58 to prevent the string 9 from slipping through the aperture 49. Winch key 45 is then turned until knot 15 on string 9 clears the bores 6 adjacent the winch 28. Stop 52 is then pushed towards plate 29 to engage with gear 48 and hold the string 9 under tension. A split washer 18 is placed over string 9 between knot 15 and outside 5 of racquet frame 3. Stop 52 can then be moved away from plate 29, thus releasing string 9. Free end 58 of string 9 is cut off adjacent knot 15 and the distance between knots 12 and 15 on string 9 assures that string 9 is at the required tension. This procedure is repeated until all strings have been placed on the racquet.

Figure 4:
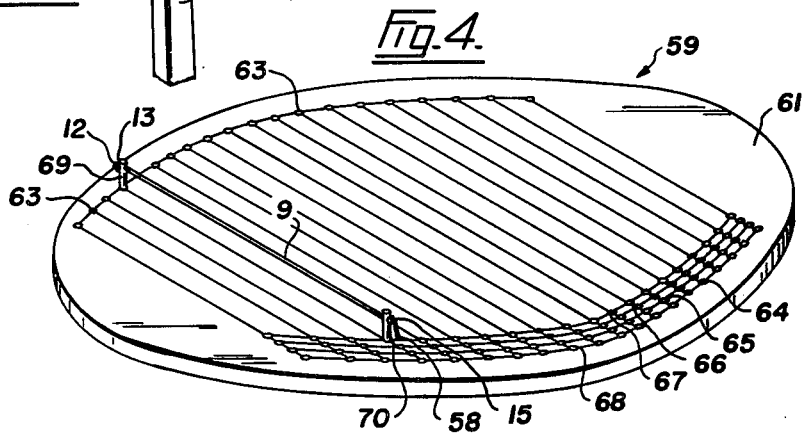
FIG. 4 is a perspective plan view of an apparatus for determining the lengths of strings which will have a given tension when placed on a racquet in a direction perpendicular to the handle.

The strings 9 may be supplied in complete sets according the tension desired in stringing the racquet or supplied as individual replacement strings which will have a predetermined tension when placed on the racquet. The individual user of the racquet may desire to make his own individual strings from a bulk supply of string. With this in mind, he will have to determine the appropriate distance between knots 12 and 15, as shown in FIG. 3, in order that the strings will have the required tension when placed on the racquet. For this purpose, measuring board 59 and 60, illustrated in FIGS. 4 and 5 respectively, are employed. Measuring board 59 and 60 are generally of similar construction. Boards 59 and 60 have bases 61 and 62, respectively, constructed of suitable material such as ¾ inch plywood. Referring first to board 59, this measuring board is employed for determining the distance between knots 12 and 15 as shown in FIG. 3, for strings running perpendicular to handle 2 of racquet 1 such as strings 21 to 23 shown in FIG. 1. Board 59 has a plurality of first positions, consisting of apertures 63 on one side of base 61. Apertures 63 correspond in position to knot 12 on strings 9. On the opposite side of base 61 from apertures 63, are located a plurality of positions in spaced sets 64, 65, 66, and 67. The sets 64, 65, 66, and 67 each have apertures 68 corresponding to the knots 15 on the strings 9 running perpendicular to handle 2 of racquet 1, when the racquet is strung. The sets 64, 65, 66, and 67 each indicate the positions of knots 15 for strings 9 having different tensions when placed on the racquets 1. For example, set 64, 65, 66, and 67 are for sets of strings having tensions of 50 pounds, 55 pounds, 60 pounds, and 65 pounds respectively when the strings 9 are placed on the racquet frame 3. Pegs 69 and 70, which may be cotter pins, are provided for fitting into the apertures 63 and 68. Apertures 63 and 68 are slightly larger than the diameter of pegs 69 and 70. Pegs 69 and 70 can be placed in any of the apertures 63 or 68. Pegs 69 and 70 have slots 71, as shown in FIG. 6, near one end. The slots 71 should be narrower than the diameter of string 9 to hold the string 9 under tension before the knot 15 is tied. The other end of pegs 69 and 70 are for placing 63 and 68. When it is desired to determine the distance between knots 12 and 15 for a string of a particular tension for a particular position on racquet 1, pegs 69 and 70 are first placed in the appropriate apertures 63 and 68. Knot 12 is then tied near end 10 of string 9, as shown in FIG. 3, washer 13 is placed over string 9, and end 10 is placed in slot 71 on peg 69 so knot 12 and washer 13 are on the side of peg 69 opposite peg 70. End 11 of string 9 is then placed through slot 72 on peg 70. End 11 is then pulled away from end 10 to take up the slack in string 9 and knot 15 is then tied in string 9 adjacent peg 70. Preferably, the end 11 of the string 9 is doubled back around peg 70 and a figure-eight knot 15 is tied around portion 73 of peg 70. The knot 15 is hand tightened; then peg 70 is removed from the knot 15 and the knot is further tightened. Alternatively the string 9 could be marked with a felt marker and removed from the pegs, the knot being tied adjacent the mark. These steps are repeated for each string required. Apertures 63 and apertures 68 are spaced so that knots 12 and 15 are closer together when adjacent pegs 69 and 70 respectively than the distance between knots 12 and 15 when string 9 is strung on racquet 1. Consequently the strings 9 will have a tension, when placed on frame 3, corresponding to the chosen set of positions 64 to 67.

Figure 5:
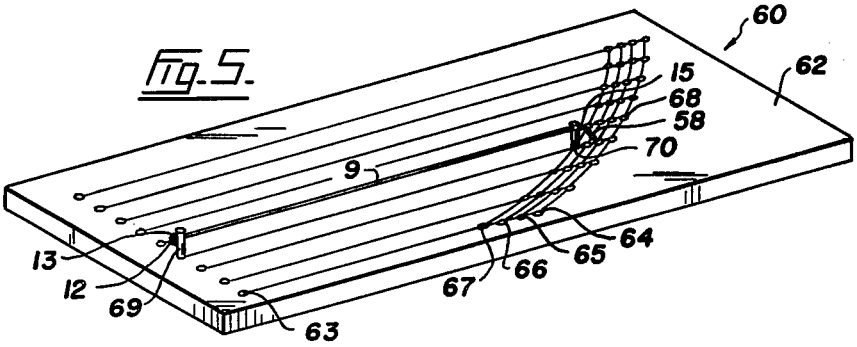
FIG. 5 is a perspective view of an apparatus for determining the length of strings that will have a given tension when placed on the racquet in a direction parallel to the handle.
Figure 6:
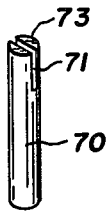
FIG. 6 is a perspective view of a peg for holding the ends of a string on the apparati shown in FIGS. 4 and 5.

Referring to FIG. 5, board 60 is employed for determining the distance between knots 12 and 15 for strings 9 running parallel to handle 2 of racquet 1 such as strings 24 to 27 shown in FIG. 1. Board 60 is similar to board 59 and like parts are numbered the same. In the case of board 60, however, there are positions 63 and 68 corresponding only to the strings 9 on one half of the racquets. Since the racquet is symmetrical, each pair of corresponding positions on board 60 is used for two strings.

Figure 9:
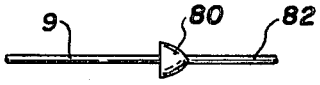
FIG. 9 is a side elevational view of a string retainer.

FIG. 9 shows a string retainer 80 alternative to the knots 12 and 15 shown in FIG. 3. The retainer 80 is made of a suitable plastic and molded about the string 82 to assure a good bond. Alternatively, the retainer 80 could be integral with the strings.

In alternative embodiments, the retainer 80 could be sized at one of the string to replace both the knot 12 and the washer 13 as shown in FIG. 3.

In a further alternative embodiment, the washers 13 and 16, as shown in FIG. 3 could be of another suitable plastic other than nylon or could be made of a metal such as aluminum.

What I claim is:

1. A racquet comprising a plurality of strings, each string having a portion of increased cross-sectional extent near each end, a plurality of collars, each collar having a central aperture smaller in cross section than said portions of the strings, a frame with an inside, an outside and a handle, the frame having a plurality of first apertures extending from the inside of the frame towards the outside of the frame, each first aperture having a cross-sectional extent generally the same as said portions of the strings, each string being secured to the frame at two ends, extending through two first apertures and spanning the frame once, the portions of the strings of increased extent being located outwardly from the first apertures and the collars being tightly fitted between the portions of the strings and the first apertures to prevent the portions from passing through the apertures, at least one collar for each string having a slit extending outwardly from the central aperture for placing the one collars over the strings after first ends of the strings are secured to the frame and the portions of increased extent near second ends of the strings are tensioned to clear the first apertures outwardly.

2. A racquet as claimed in claim 1, the frame having a plurality of second apertures, each second aperture extending from the outside of the frame to a first aperture and having a cross-sectional extent generally the same as the collars, the collars each fitting within the second apertures to prevent the slits of the one collars from spreading.

3. A racquet as claimed in claim 1, the portions of the strings comprising knots on the strings.

4. A racquet as claimed in claim 3, the collars comprising flat nylon washers.

5. A method of stringing a racquet comprising:

providing a racquet with a frame and a plurality of spaced-apart first apertures extending through the frame;

providing at least one string having two ends, a portion of increased cross-sectional extent near each end and having means for preventing a first end from passing through the first apertures;

passing a second end of the string inwardly through one first aperture;

passing the second end outwardly through another first aperture so the string spans the frame in a given position;

pulling the second end outwardly from the frame until the portion of increased extent near the second end outwardly clears said another first aperture;

positioning means on the string between the portion of increased extent near the second end and said another first aperture to prevent the portion near the second end from passing through said another first aperture; and releasing the second end so the string spans the racquet at the required tension.

6. A method of stringing as claimed in claim 5, comprising:

providing a string with a length greater than a length to span the racquet in the given position;

placing a first collar over the string to provide the means for preventing the first end from passing through the one first aperture; and tying a knot near each end of the string to provide the portions of increased cross-sectional extent, the knots being spaced apart so that the string will have the required tension when positioned on the frame.

7. A method of stringing as claimed in claim 5, comprising:

providing a second collar for each string having an outwardly extending slit; and putting the string through the slit of the second collar between the frame and the portion of increased cross-sectional extent near the second end of the string after the second end is pulled outwardly to prevent the portion near the second end from passing through said another first aperture.

8. A method of stringing as claimed in claim 5 including pulling the second end of the string outwardly with a winch positioned against the frame and connected to a short length of string extending from the portion of increased extent near the second end.

9. A method of stringing as claimed in claim 5 comprising:

stringing the racquet with two sets of strings so that a first set of strings is generally parallel to a handle connected to the frame and a second set of strings is generally perpendicular to the first set of strings, at least one string of the second set being first strung near the center of the racquet, the first set of strings then being strung in corresponding pairs beginning near the center of racquet and progressing outwardly and then completing the stringing of the second set of strings.

* * * * *